United States Patent [19]

Nixdorff et al.

[11] Patent Number: 4,503,986

[45] Date of Patent: Mar. 12, 1985

[54] TAMPER-EVIDENT CLOSURE CAP

[75] Inventors: Frank S. Nixdorff, Baltimore, Md.; Arthur H. Dornbusch, Cincinnati, Ohio

[73] Assignee: Anchor Hocking Corporation, Lancaster, Ohio

[21] Appl. No.: 595,534

[22] Filed: Mar. 30, 1984

[51] Int. Cl.[3] ..... B65D 41/34

[52] U.S. Cl. ..... 215/252; 215/258; 215/330

[58] Field of Search ..... 215/250, 252, 258, 330, 215/335

[56] References Cited

U.S. PATENT DOCUMENTS

| | | | |
|---|---|---|---|
| 3,968,894 | 7/1976 | Herrmann | 215/258 X |
| 4,278,180 | 7/1981 | Willis | 215/252 |
| 4,337,870 | 7/1982 | Keeler | 215/252 |
| 4,448,318 | 5/1984 | Lowe | 215/252 |
| 4,461,391 | 7/1984 | Davis | 215/252 |

*Primary Examiner*—Steven M. Pollard

*Attorney, Agent, or Firm*—Stoll, Wilkie, Previto & Hoffman

[57] ABSTRACT

A tamper-evident closure for sealing a package cooperates with a separately applied indicator ring, which is torn apart during the opening of the package, so that a portion of the indicator ring drops clear of the closure to indicate that the closure has been turned at least partially off of the package. The indicator ring has a lower mounting portion and an upper ratchet and indicating portion which is connected to the lower mounting portion of the ring by a series of frangible connectors which are ruptured as the cap is removed.

10 Claims, 11 Drawing Figures

Fig. 1.
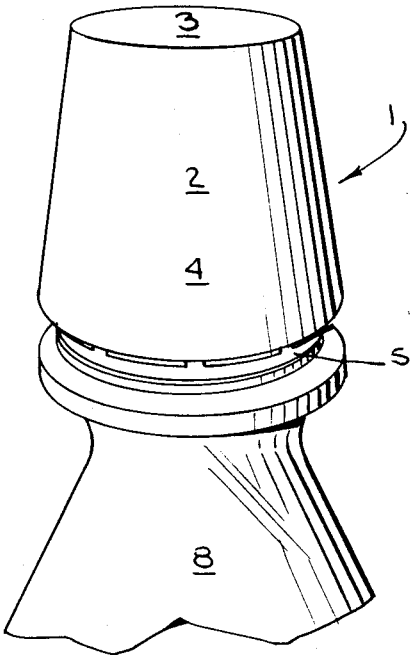
Fig. 2.
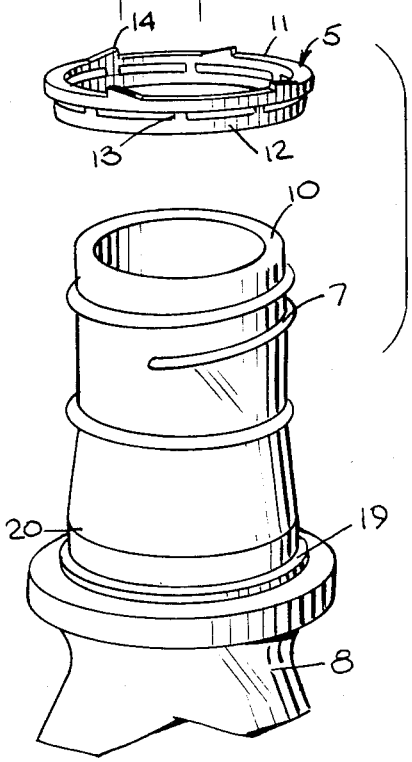
Fig. 3.
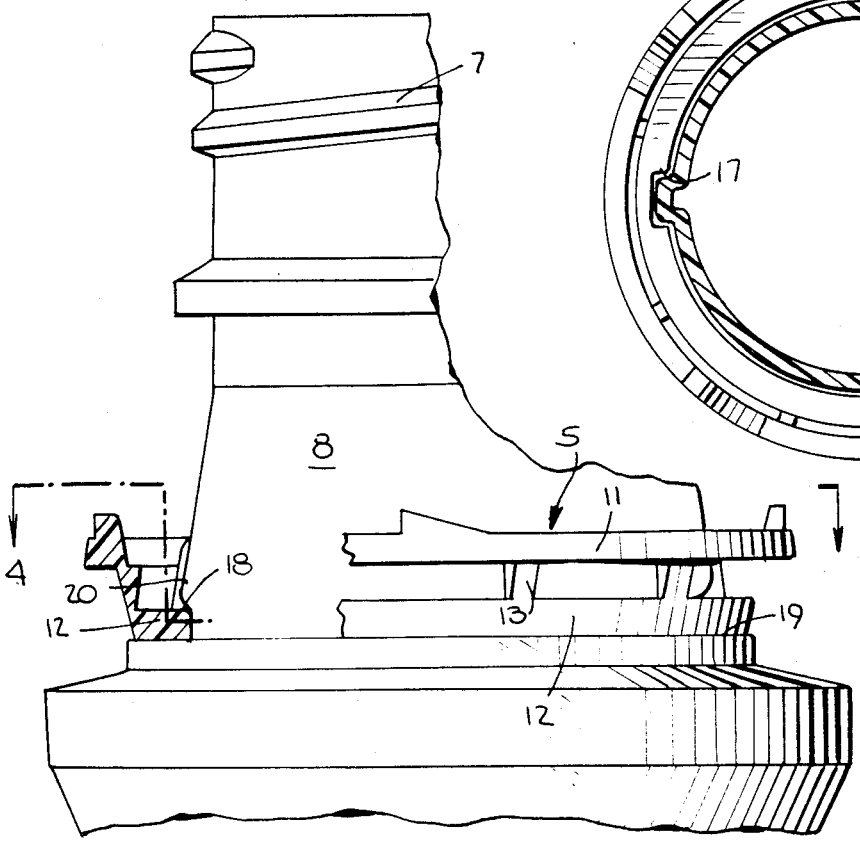
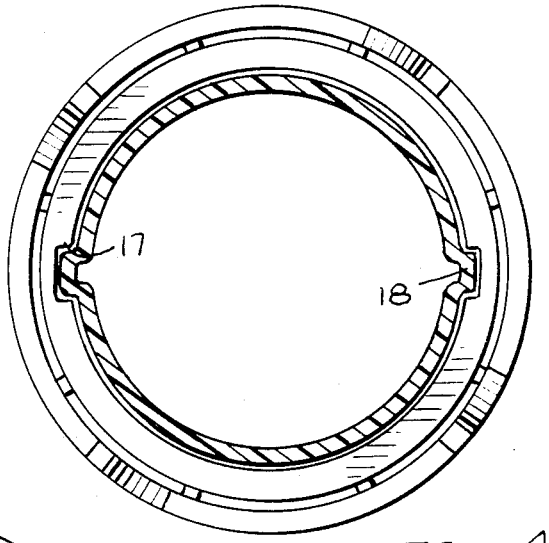
Fig. 4.

Fig. 9.
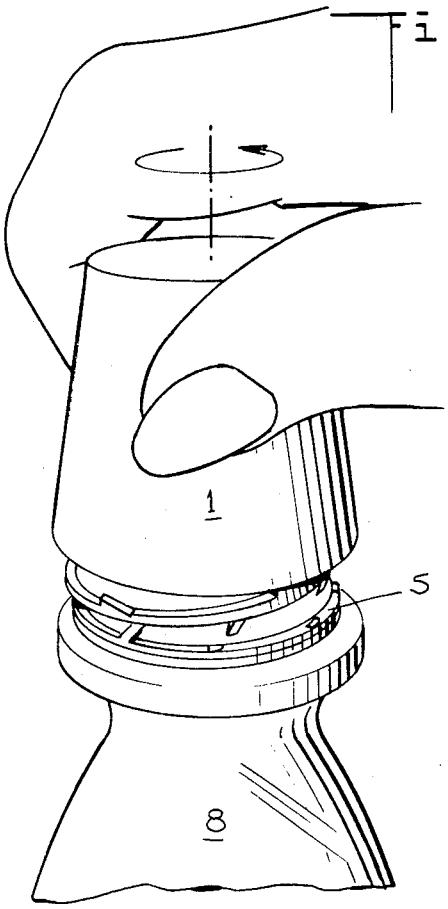
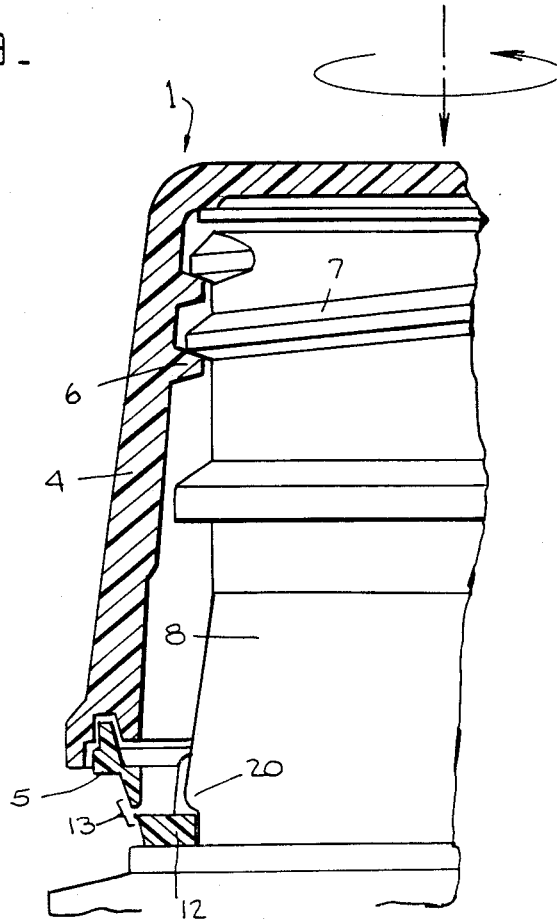
Fig. 10.
Fig. 11.
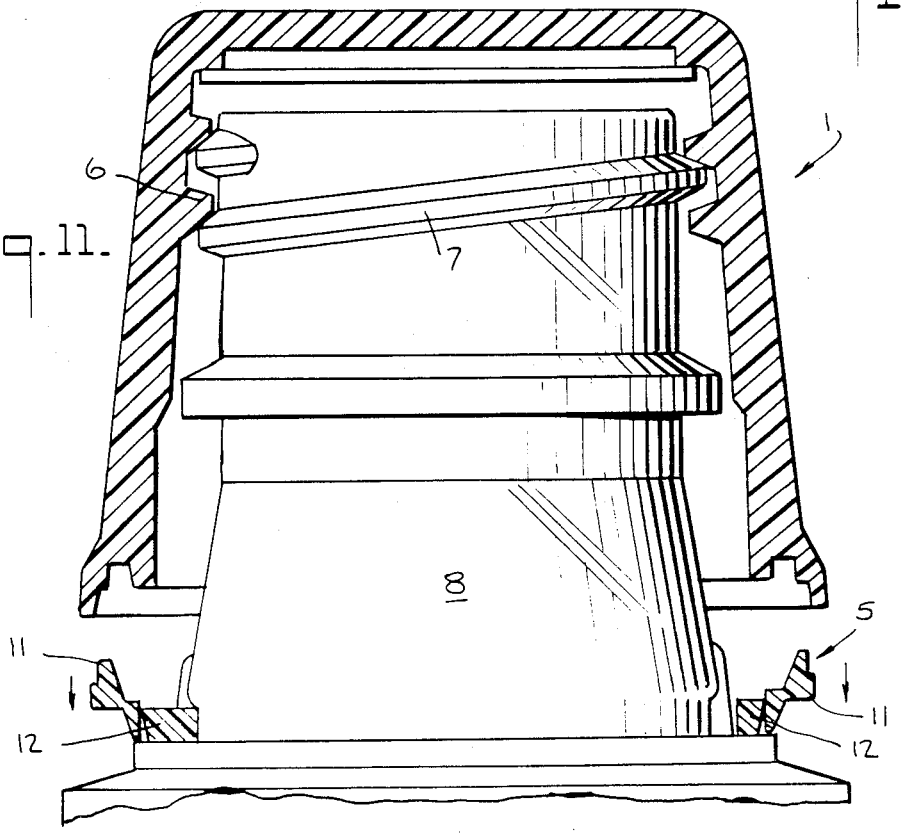

TAMPER-EVIDENT CLOSURE CAP

BACKGROUND OF THE INVENTION

The present invention relates to a tamper-evident closure having a tamper indicating ring which indicates any attempt to remove the closure and which thus shows an unauthorized tampering with the sealed packages.

There are a variety of tamper-evident closures including a number of closures which have a lower portion of their skirt fastened to a portion of the sealed container. These fastened portions are generally connected to the remainder of the closure with a line of weakness or a fracturable connection so that this portion remains on the closure as the cap is removed thereby indicating that the closure has been at least partially removed.

These closures, while useful in certain applications, have certain disadvantages in many applications including products packaged in glass or plastic containers. The application of this type of closure is difficult as well as the manufacture of the closure with the provision of the above described line of weakness.

The closure of the present application is easily applied requiring only a simple application of the ring to the container and a subsequent container sealing wherein the closure itself need only be turned on to the container using the usual sealing machinery. This provides for an easily manufactured, tamper-evident closure as well as for a closure which is easily applied in the package sealing operation and which provides a positive and clear tamper indication.

Accordingly, an object of the present invention is to provide an improved tamper-evident closure.

Another object of the present invention is to provide an easily manufactured tamper-evident closure.

A still further object of the present invention is to provide an easily applied tamper-evident closure.

A further object of the invention is to provide a tamper-evident closure with a positive and clearly visible tamper indication.

Other and further objects of the present invention will become apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a perspective view of a container sealed with the tamper-evident closure of this invention.

FIG. 2 is an exploded perspective illustration showing a preferred embodiment of the tamper indicating ring and a cooperating container.

FIG. 3 is a side elevational view partially in section illustrating the tamper indicating ring in position on the container.

FIG. 4 is a sectional view of the tamper indicating ring and the container taken along line 4—4 on FIG. 3.

FIG. 9 is a perspective view illustrating the removal of the closure cap and the related rupture of the tamper indicating ring.

FIG. 10 is a vertical sectional view illustrating the rupture of the tamper indicating ring section from the keyed lower section of the ring.

FIG. 11 is a vertical sectional view illustrating the tamper indicating portion of the ring turned free from the remaining keyed portion of the ring and dropped to its tamper indicating position.

DESCRIPTION OF THE PREFERRED EMBODIMENT

Figure 5:
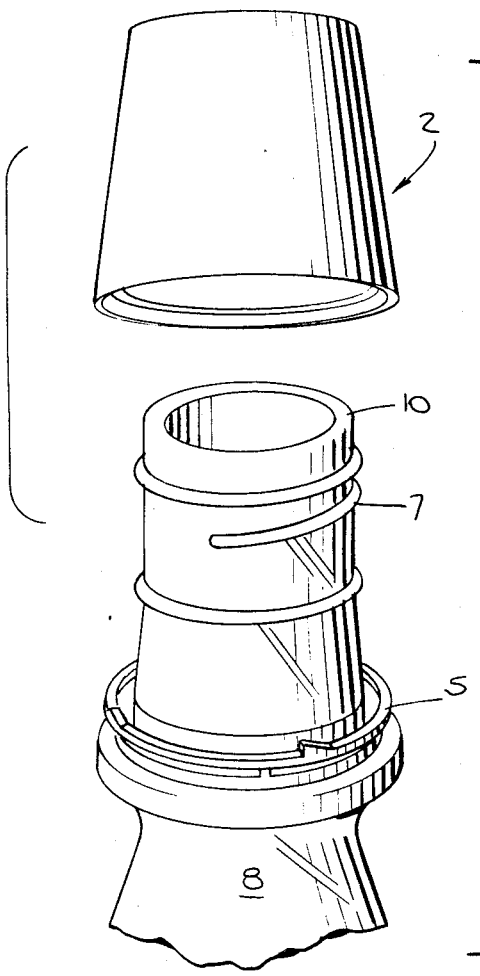
FIG. 5 is a perspective view illustrating the tamper indicating ring in position on the container prior to the application of the closure cap.

A preferred embodiment of the closure cap is illustrated in the drawings. The closure cap 1 has a sealing portion 2 comprising a cover 3 and a depending skirt 4 and a molded tamper indicating ring 5 which cooperates with the sealing portion 2 for providing the tamper indication as further described below. The sealing portion 2 includes threads 6 (FIG. 7) on the inner sidewall of the skirt 4 for engaging cooperating threads 7 on the container 8. A gasket 9 is positioned on the underside of the cap cover 3 for forming a seal with the container rim 10. A cut liner is illustrated, however, other known gaskets such as flowed-in plastisol or molded plastic liners may be used.

Figure 7:
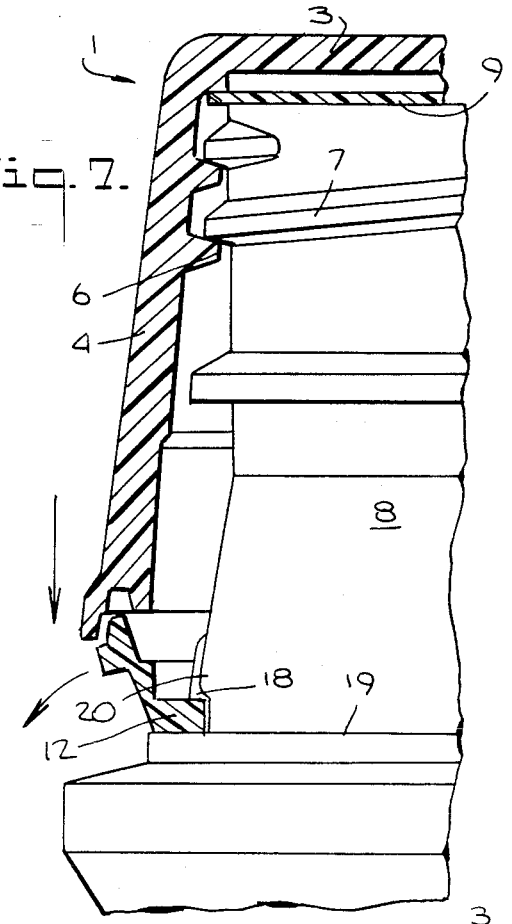
FIG. 7 is a vertical sectional view illustrating the application of the closure to the container and into engagement with the tamper indicating ring and illustrating a flexing of the ring during the closure application.
Figure 8:
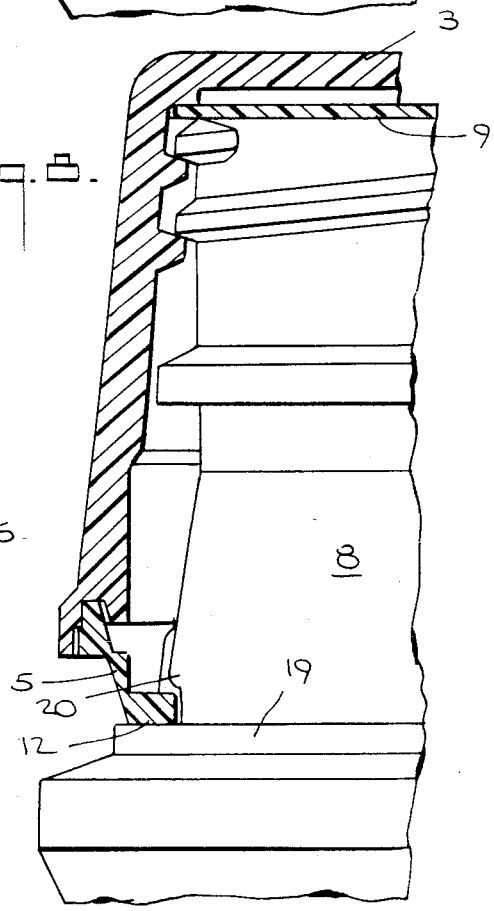
FIG. 8 is a vertical sectional view corresponding to FIG. 7 illustrating the container in its fully sealed position.
Figure 6:
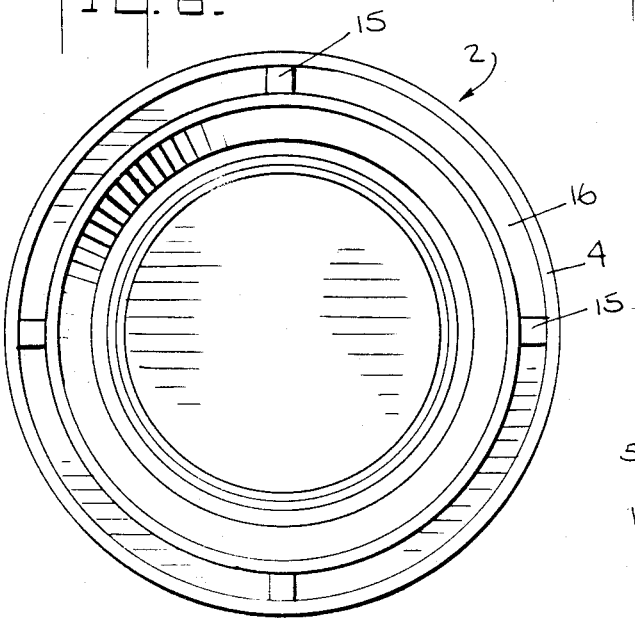
FIG. 6 is a bottom plan view of a preferred embodiment of the closure cap illustrating the ratchet elements in the channel on the bottom of the cap skirt.

The one piece tamper-evident or tamper indicating ring 5 comprises an upper ring 11 and a spaced lower ring 12 coupled together by a number of generally vertical and flexible bridges 13. Ratchet pawls 14 are molded on the upper ring 11 for engaging cooperating teeth 15 (FIG. 6) molded on a lower portion of the cap skirt 4. FIGS. 6 and 7, for example, illustrate four teeth or stops 15 equally spaced from one another within a downwardly facing groove 16 provided in the bottom of the cap skirt 4. The teeth 15 may alternatively be positioned on the lower inner sidewall of the cap skirt 4.

The tamper indicating ring 5 is locked against rotation on the container 8 by one or more notches 17 which engage cooperating lugs 18 provided on the neck of the container 8 as illustrated in FIGS. 4 and 7.

The container 8 is sealed by first applying the tamper indicating ring 5 to the container 8 neck by lowering it downwardly until its bottom ring 12 engages a flange 19 on the container 8. The ring 5 is adjusted during application so that its notches 17 are engaged by the spaced stops 18 on the container 8.

Thereafter the sealing portion 2 of the closure cap is applied to the container 8 and is screwed downwardly to move the sealing gasket 9 into sealing relationship with the container rim 10 and simultaneously to move the teeth 15 over the pawls 14. When the sealing portion of the cap 2 has been moved into sealing relationship with the container 8, the teeth 15 are below the tops of the pawls 14 and adjacent to the upper surface of the upper ring 11. The passage of the teeth 15 over the pawls 14 is facilitated by a downward flexing or movement of the upper ring 11 which is permitted by the resilient nature of the several molded bridges 13 which temporarily bend or bow during the cap application.

Thus, in the sealed position, the pawls 14 will have entered into the channel on the lower surface of the closure skirt 4 with their upper most portions at least being above the teeth 15.

When the sealing portion 2 is turned off, the teeth 15 strike the generally vertical edges of the pawls 14 and the upper ring 11 is torn clear of the lower ring 12 as the connecting bridges 13 are ruptured. This leaves the upper ring 12 free and causes it to drop downwardly over the smaller lower ring 12 giving a clear indication that an attempt has been made to open the package. Due to the presence of the four spaced teeth 15 in the preferred embodiment, this detachment of the upper ring 11 will occur no later than after about a 90° turn of the closure sealing portion 2 and preferably after less than about a 45° turn where the relationship between the rim 10 and threads 6 and 7 is designed to position a fully sealed closure with the pawls about midway between the teeth 15. The loose and fallen ring 11 provides a clear indication of an unauthorized tampering and of a possible destruction of the seal even though the sealing portion has been only turned a slight amount.

It will be seen that an improved tamper-evident closure has been described which is fool-proof and effective and easily manufactured. The closure may be applied readily in the initial sealing and the tamper-evident arrangement is resistant to damage or premature destruction during the package sealing and distribution.

As various changes may be made in the form, construction and arrangement of the invention and without departing from the spirit and scope of the invention, and without sacrificing any of its advantages, it is to be understood that all matter herein it to be interpreted as illustrative and not in a limiting sense.

Having thus described our invention, we claim:

1. A tamper-evident closure cap for sealing a container comprising the combination of:

a molded plastic sealing portion including a cover and a depending skirt;

thread means on said skirt for engaging cooperating thread means on the container;

a molded plastic tamper indicating member for encircling the container mouth below the closure cap;

means for preventing the indicating member from moving on the container;

said indicating member comprising spaced portions detachably connected by frangible members;

ratchet means operatively coupling said sealing portion to one of said indicating member portions causing said one portion to turn with the sealing portion when the sealing portion is turned off of the container for separating the indicating member portions.

2. The tamper-evident closure as claimed in claim 1, in which said thread means comprise continuous threads.

3. The tamper-evident closure as claimed in claim 1, in which said indicating member portions comprise an upper ring and a smaller diameter lower ring and said frangible members comprise a plurality of generally vertical bridge members detachably connecting said rings.

4. The tamper-evident closure as claimed in claim 3, in which said ratchet means comprises a plurality of pawl members on the upper ring and a plurality of ratchet teeth on the lower portion of said depending skirt.

5. The tamper-evident closure as claimed in claim 4, in which said ratchet teeth are mounted within a downwardly facing channel on the lower edge of said cap skirt.

6. A tamper-evident closure cap for sealing a container comprising the combination of:

a molded plastic sealing portion including a cover and a depending skirt;

thread means on said skirt for engaging cooperating thread means on the container;

a molded tamper indicating plastic ring for encircling the container mouth below the closure cap;

means for preventing the ring from rotating on the container;

said ring comprising an upper ring portion and a smaller lower ring portion detachably connected by frangible bridges;

ratchet means operatively coupling the sealing portion and the ring causing the upper ring portion to turn with the sealing portion when it is turned off of the container for separating the ring portions to provide the tamper indication.

7. The tamper-evident closure as claimed in claim 6, in which said thread means comprise continuous threads.

8. The tamper-evident closure as claimed in claim 6, in which said frangible bridges comprise a plurality of generally vertical frangible bridge members detachably connecting said rings.

9. The tamper-evident closure as claimed in claim 6, in which said ratchet means comprises a plurality of pawl members on the upper ring and a plurality of ratchet teeth on the lower portion of said depending skirt.

10. The tamper-evident closure as claimed in claim 9, in which said ratchet teeth are mounted within a downwardly facing channel on the lower edge of said cap skirt.

* * * * *